United States Patent [19]

Shands et al.

[11] Patent Number: 4,961,968

[45] Date of Patent: Oct. 9, 1990

[54] SHORT DWELL COATER APPARATUS WITH BACKING BLANKET DISPOSED BETWEEN BLADE AND GUIDE ROLL

[75] Inventors: Jay Shands, Beloit, Wis.; John Schamell, Roscoe, Ill.; Gerald Garde; Robert Carlson, both of Beloit, Wis.

[73] Assignee: Beloit Corporation, Beloit, Wis.

[21] Appl. No.: 329,618

[22] Filed: Mar. 28, 1989

[51] Int. Cl.[5] ..... B05D 3/12

[52] U.S. Cl. ..... 427/356; 118/410

[58] Field of Search ..... 427/356; 118/410

[56] References Cited

U.S. PATENT DOCUMENTS 3,792,682 2/1974 Phipps ..... 118/62
4,761,309 8/1988 Emeby ..... 427/294

FOREIGN PATENT DOCUMENTS 1546965 11/1971 Fed. Rep. of Germany .
8700091 1/1987 World Int. Prop. O. .

OTHER PUBLICATIONS

Derwent's Abstract No. 96788 E/45, SU 895,536, Publ. Week 8245.

*Primary Examiner*—Shrive Beck
*Assistant Examiner*—Alain Bashore
*Attorney, Agent, or Firm*—Dirk J. Veneman; Raymond W. Campbell; David J. Archer

[57] ABSTRACT

A coater apparatus is disclosed for applying a primary flow of coating material to a moving web of paper. The apparatus includes a frame and a first and a second guide roll rotatably supported by the frame. The first and second guide rolls rotate respectively around first and second rotational axes. The second axis of rotation is disposed spaced and parallel relative to the first axis. A backing blanket extends around and is guided by the guide rolls. The blanket defines an endless loop around the guide rolls such that the web of paper is supported by the blanket during movement of the web from the first guide roll to the second guide roll. The blanket is disposed between the web and the guide rolls. A short dwell coater is disposed adjacent to the web and between the guide rolls for applying the primary flow of coating material to the web. While the web supported by the blanket is moving between the guide rolls, the web is moving in a plane disposed tangentially relative to the guide rolls such that secondary flows within the coater are inhibited.

7 Claims, 1 Drawing Sheet

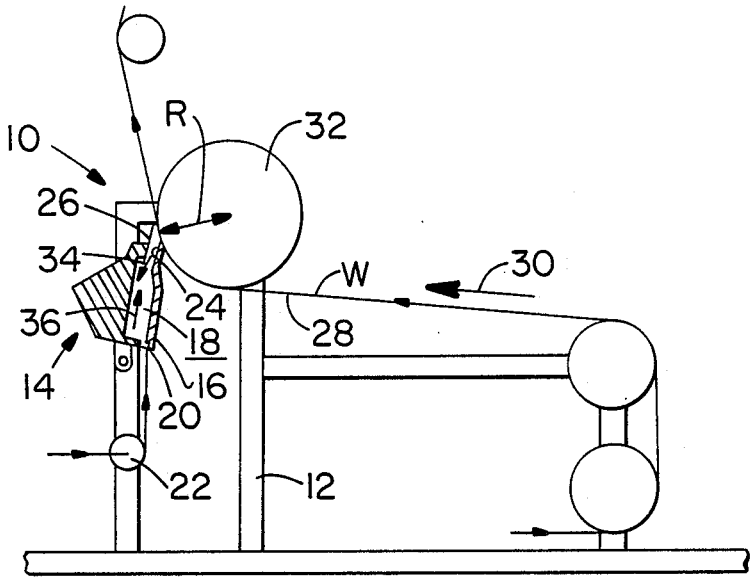
FIG. 1
PRIOR ART
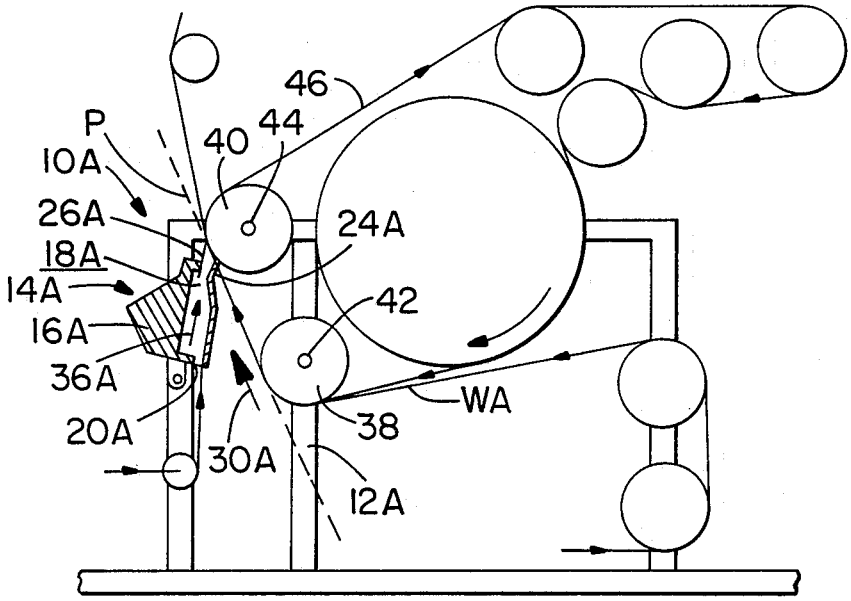
FIG. 2
FIG. 3
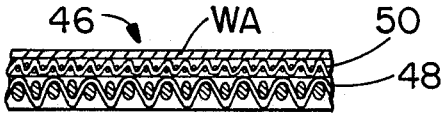

SHORT DWELL COATER APPARATUS WITH BACKING BLANKET DISPOSED BETWEEN BLADE AND GUIDE ROLL

BACKGROUND OF THE INVENTION

1. Field of the Invention

The present invention relates to a coater apparatus for applying a primary flow of coating material to a moving web of paper. More particularly, the present invention relates to a coater apparatus which includes a backing blanket disposed on the opposite side of the paper web relative to a short dwell coater.

2. Information Disclosure Statement

Short dwell coaters are capable of coating a web of paper at speeds of 3,000 feet per minute and upwards thereof.

A short dwell coater essentially includes a housing defining a coating chamber and having an inlet connected to a supply of coating material and an outlet disposed adjacent to a moving web of paper. Pressurized coating material flows through the coating chamber and through the outlet where such coating material comes into intimate contact with an adjacent surface of the moving web of paper. A flexible metering blade is disposed immediately downstream relative to the outlet so that coating material applied to the surface of the paper web is metered and smoothed onto the web. In view of the relatively short residence time of any point on the moving web contacting the outlet, such coaters have been termed "short dwell coaters". Such "short dwell" or resident time inhibits excessive absorption of the coating material into the moving web. Consequently, such short dwell coaters not only reduce the amount of coating material required, but also reduce the amount of time required for such coating material to be dried.

In the prior art, a short dwell coater is typically disposed adjacent to a backing roll such that the web to be coated extends between the short dwell coater blade and the backing roll so that the coating material is applied to the moving web directly supported by the backing roll.

With the aforementioned arrangement using a backing roll, there exists a problem when operating such a coater at relatively high speeds over 3,000 feet per minute. The aforementioned problem is caused by the radius of the backing roll which generates a centrifugal force within the coating material being applied. Such centrifugal force generated within the coating material causes secondary or back flow within the coating chamber of the short dwell coater. Such secondary flow tends to disturb the primary flow of coating material from the coating chamber through the outlet onto the moving web causing uneven distribution of coating material in a cross-machine direction. This uneven distribution contributes to coating weight non-uniformities in the resultant coated web.

The present invention overcomes the aforementioned problem of the prior art arrangements by providing a backing blanket extending in a closed loop around a first and second guide roll. The web of paper is supported by the backing blanket and the short dwell coater is disposed adjacent to the planar run of the backing blanket between the guide rolls. By this means, because of the absence of any centrifugal force tending to throw the coating material away from the backing blanket, the aforementioned deleterious secondary flows are inhibited.

Therefore, it is a primary objective of the present invention to overcome the aforementioned inadequacies of the prior art proposals and to provide a coater apparatus that makes a considerable contribution to the art of applying coating material to a moving web of paper.

Another object of the present invention is the provision of a coater apparatus which includes a first and a second guide roll and a backing blanket extending in an endless loop between the guide rolls so that the backing blanket supports the moving web of paper and a short dwell coater is disposed adjacent to the planar run of the backing blanket, thereby inhibiting secondary flows within the coater.

Another object of the present invention is the provision of a coater apparatus in which the backing blanket includes a woven base fabric and a surface layer for supporting a moving web.

Another object of the present invention is the provision of a coater apparatus having a backing blanket which is of composite construction, including a woven base fabric and a woven surface layer having a lower denier than the denier of the base fabric.

Another object of the present invention is the provision of a coater apparatus in which the short dwell coater includes a housing defining a coating chamber. The coating chamber has a coater outlet and a resilient blade disposed adjacent to the outlet. The blade is disposed downstream relative to the outlet for metering and smoothing the coating material onto the moving web such that the secondary flows that would be generated within the coating chamber with the use of a backing roll are inhibited by the use of the planar disposition of the moving web supported by the blanket.

Another object of the present invention is the provision of a coater apparatus in which the resilient blade is disposed adjacent to the second guide roll such that the web and the backing blanket are disposed between the blade and the second guide roll so that the blade is fully supported by the second guide roll. The outlet is disposed upstream relative to the second guide roll and between the guide rolls.

Other objects and advantages of the present invention will be readily apparent to those skilled in the art by a consideration of the detailed description contained hereinafter taken in conjunction with the annexed drawings.

SUMMARY OF THE INVENTION

The present invention relates to a coater apparatus and method for applying a primary flow of coating material to a moving web of paper. The apparatus includes a frame and a first and a second guide roll rotatably supported by the frame. The first guide roll rotates about a first rotational axis and the second guide roll rotates about a second rotational axis. The second axis is disposed spaced and parallel relative to the first axis.

A backing blanket extends around and is guided by the guide rolls. The blanket defines an endless loop around the guide rolls such that the web of paper is supported by the blanket during movement of the web from the first guide roll to the second guide roll. The blanket is disposed between the web and the guide rolls, and a short dwell coater is disposed adjacent to the web and between the guide rolls. The short dwell coater applies the primary flow of coating material to the web while the web supported by the blanket is moving in a plane which is disposed tangentially relative to the guide rolls. The arrangement is such that secondary flows within the coater are inhibited.

In a more specific embodiment of the present invention, the distance between the axes of the guide rolls is within the range 12 to 23 feet.

The first guide roll is disposed below the second guide roll such that when the web of paper moves between the first and the second rolls, the web moves upwardly towards the second guide roll.

The backing blanket includes a woven base fabric and a surface layer which is disposed contiguously relative to the base fabric such that the surface layer supports the paper web. More particularly, the surface layer is woven and has a lower denier than the denier of the base fabric.

The short dwell coater also includes a housing which defines a coating chamber having a coater inlet and a coater outlet. A resilient blade is disposed adjacent to the outlet with the blade being disposed downstream relative to the outlet. The blade assists in metering and smoothing the coating material onto the moving web such that secondary flows that would be generated within the coating chamber with the use of a backing roll are inhibited by the use of the planar disposition of the moving web supported by the blanket.

The resilient blade is disposed adjacent to the second guide roll such that the web and the backing blanket are disposed between the blade and the second guide roll so that the blade is fully supported by the second guide roll. The outlet is disposed upstream relative to the second guide roll and the outlet is disposed between the guide rolls.

The present invention also includes a method for applying a primary flow of coating material to a moving web of paper. The method includes the steps of:

- rotatably supporting a first and a second guide roll such that the axes of rotation of the first and the second guide roll are disposed spaced and parallel relative to each other;
- moving a backing blanket around the guide rolls such that the blanket defines an endless loop for supporting the web of paper during movement of the web of paper from the first to the second roll; and
- applying the primary flow of coating material to the web moving between the first and the second guide rolls, the primary flow of coating material being applied through a coater outlet of a short dwell coater disposed adjacent to the web and between the guide rolls, the arrangement being such that the web supported by the blanket moves in a plane disposed tangentially relative to the guide rolls so that secondary flows of coating material within the coater are inhibited.

Many modifications and variations of the present invention will be readily apparent to those skilled in the art by a consideration of the detailed description of a preferred embodiment of the present invention taken in conjunction with the annexed drawings. However, such modifications and variations fall within the spirit and scope of the present invention as defined by the appended claims.

BRIEF DESCRIPTION OF THE DRAWINGS

FIG. 1 is a side-elevational view of a typical short dwell coater apparatus showing a moving web disposed between a short dwell coater and a backing roll;

FIG. 2 is a side-elevational view of a coater apparatus according to the present invention showing a backing blanket extending between two guide rolls so that coating material is applied to the planar run of the web supported by the backing blanket; and FIG. 3 is an enlarged sectional view of the backing blanket according to the present invention.

DETAILED DESCRIPTION OF THE DRAWINGS

FIG. 1 is a side-elevational view of a typical coater apparatus generally designated 10 for applying a primary flow of coating material to a moving web of paper W. The apparatus 10 includes a frame 12 and a short dwell coater generally designated 14. The short dwell coater 14 includes a housing 16 defining a coater chamber 18. The coater chamber 18 has an inlet 20 connected to a source of pressurized coating material 22. The chamber 18 also includes an outlet 24 disposed adjacent to the moving web W. A flexible resilient blade 26 is disposed downstream relative to the outlet 24 so that in use of the apparatus 10, coating material flows through the chamber 18 and through the outlet 24 onto the outer surface 28 of the moving web W. As the web W moves in the direction indicated by the arrow 30, the blade 26 meters and smooths the coating material onto the surface 28 of the web W.

A backing roll 32 is disposed on the opposite side of the web W relative to the short dwell coater 14 so that the blade 26 is supported by the backing roll 32. However, because of the radius R of the backing roll 32, there exists a tendency for the coating material applied to the surface 28 through the outlet 24 to be thrown by centrifugal force radially outwardly. Such centrifugal force tends to create secondary flows within the coating material disposed within the inlet 24 and the coating chamber 18 as indicated by the arrow 34. The secondary flows 34 interfere with the primary flow of coating material as indicated by the arrow 36 so that there exists a non-uniform flow of coating material onto the moving web W. This non-uniform flow of coating material results, or at least contributes to, coat weight nonuniformities in the resultant coated web.

FIG. 2 is a side-elevational view of a coater apparatus generally designated 10A according to the present invention for applying a primary flow 36A of coating material onto a moving web of paper WA. The apparatus 10A includes a frame 12A and a first and second guide roll 38 and 40 respectively. The guide rolls 38 and 40 are rotatably supported by the frame 12A. The first guide roll 38 rotates about a first rotational axis 42 and the second guide roll 40 rotates about a second rotational axis 44. The second axis 44 is disposed spaced and parallel relative to the first axis 42.

As shown in FIG. 2, a backing blanket 46 extends around and is guided by the guide rolls 38 and 40. The blanket 46 defines an endless loop around the guide rolls 38, 40 such that the web of paper WA is supported by the blanket 46 during movement of the web WA from the first guide roll 38 to the second guide roll 40. The blanket 46 is disposed between the web WA and the guide rolls 38 and 40 respectively. A short dwell coater generally designated 14A is disposed adjacent to the web WA and between the guide rolls 38 and 40 for applying the primary flow 36A of coating material to the web WA while the web WA supported by the blanket 46 is moving in a plane P disposed tangentially relative to the guide rolls 38 and 40 respectively such that secondary flows within the coater 14A are inhibited.

In a specific embodiment of the present invention, the first axis of rotation 42 is disposed at a distance within the range 12 to 23 feet from the second axis 44, and the first guide roll 38 is disposed below the second guide roll 40 such that when the web of paper WA moves between the first and second rolls 38 and 40 respectively, the web WA moves upwardly as indicated by the arrow 30A towards the second guide roll 40.

FIG. 3 is an enlarged sectional view of the blanket 46 as shown in FIG. 2.

The backing blanket 46, as shown in FIG. 3, also includes a woven base fabric 48 and a surface layer 50 which is disposed contiguously relative to the base fabric 48. The surface layer 50 supports the paper web WA.

More specifically, the backing blanket 46 is of composite construction and includes a woven surface layer 50 which has a lower denier than the denier of the base fabric 48.

The short dwell coater generally designated 14A also includes a housing 16A which defines a coater chamber 18A having a coater inlet 20A and a coater outlet 24A. A resilient blade 26A is disposed adjacent to the outlet 24A. The blade 26A is disposed downstream relative to the outlet 24A for metering and smoothing the coating material onto the moving web WA such that the secondary flows 34, described with reference to the prior art proposal shown in FIG. 1 that would be generated within the coating chamber, are inhibited by the use of the planar disposition of the moving web WA supported by the blanket 46.

As shown in FIG. 2, the resilient blade 26A is disposed adjacent to the second guide roll 40 such that the web WA and the backing blanket 46 are disposed between the blade 26A and the second guide roll 40 so that the blade 26A is fully supported by the second guide roll 40. Also, the outlet 24A is disposed upstream relative to the second guide roll 40. Furthermore, the outlet 24A is disposed between the guide rolls 38 and 40.

In operation of the coater apparatus shown in FIG. 2, the backing blanket 46 is guided by a plurality of rolls, including guide rolls 38 and 40, to define an endless loop. The web WA extends between and is guided about guide rolls 38 and 40 so that the web WA runs contiguously with the backing blanket 46 between the guide rolls 38 and 40. The short dwell coater 14A is brought into operative cooperation with the web extending between rolls 38 and 40 so that the resilient blade 26A bears against the second roll 40 in the vicinity of the tangent point between the plane P and the roll 40. Accordingly, the outlet 24A of the short dwell coater is disposed upstream relative to the aforementioned tangent point and the web in contact with the outlet 24A is moving along the plane P because the web is supported by the planar run of the backing blanket 46 between rolls 38 and 40. Accordingly, because of the planar run of the web WA adjacent to the coater outlet 24A, there exists no centrifugal force to throw the coating material radially outwardly from the second guide roll 40. Therefore, secondary flows in opposition to the primary flow 36A is inhibited and a more even distribution of the coating material is accomplished.

The present invention not only avoids the generation of secondary flows within the coating chamber, but also provides a backing blanket which may be easily replaced when necessary.

Furthermore, the present invention avoids problems associated with covered backing rolls and the inherent problem of separation of the relatively soft cover material from the supporting backing roll.

What is claimed is:

1. A coater apparatus for applying a primary flow of coating material to a moving web of paper, said apparatus comprising:

a frame;

a first and a second guide roll rotatably supported by said frame, said first guide roll rotating about a first rotational axis, said second guide roll rotating about a second rotational axis, said second axis being disposed spaced and parallel relative to said first axis;

a backing blanket extending around and being guided by said guide rolls, said blanket defining an endless loop around said guide rolls such that the web of paper is supported by said blanket during movement of the web from said first guide roll to said second guide roll, said blanket being disposed between the web and said guide rolls;

a short dwell coater disposed adjacent to the web and between said guide rolls for applying the primary flow of coating material to the web while the web supported by said blanket is moving in a plane disposed tangentially relative to said guide rolls such that secondary flows within said coater are inhibited;

said short dwell coater further including;

a housing defining a coating chamber having a coater outlet;

a resilient blade disposed adjacent to said outlet, said blade being disposed downstream relative to said outlet for metering and smoothing the coating material onto the moving web;

said resilient blade being disposed immediately adjacent to said second guide roll such that the web and said backing blanket are disposed between said blade and said second guide roll so that said blade is fully supported by said second guide roll; and said outlet being disposed upstream relative to said second guide roll such that the web moving past said outlet moves in said plane so that generation of secondary flows within the coating material disposed within said outlet and said coating chamber are inhibited.

2. A coater apparatus as set forth in claim 1 wherein said first axis of rotation is disposed at a distance within the range 12 to 23 feet from said second axis.

3. A coater apparatus as set forth in claim 1 wherein said first guide roll is disposed below said second guide roll such that when the web of paper moves between said first and second rolls, the web moves upwardly towards said second guide roll.

4. A coater apparatus as set forth in claim 1 wherein said backing blanket further includes:

a woven base fabric;

a surface layer disposed contiguously relative to said base fabric, said surface layer supporting the paper web.

5. A coater apparatus as set forth in claim 1 wherein said backing blanket is of composite construction and includes:

a woven base fabric;

a wove surface layer having a lower denier than the denier of said base fabric.

6. A coater apparatus as set forth in claim 2 wherein said blade is disposed downstream relative to said outlet for metering and smoothing the coating material onto the moving web such that said secondary flows that would be generated within said coating chamber with the use of a backing roll are inhibited by use of the planar disposition of the moving web supported by said blanket.

7. A method for applying a primary flow of coating material to a moving web of paper, said method comprising the steps of:

rotatably supporting a first and second guide roll such that the axis of rotation of the first and the second guide rolls are disposed spaced parallel relative to each other;

moving a backing blanket around the guide rolls such that the blanket defines an endless loop for supporting the web of paper during movement of the web of paper from the first to the second roll;

applying the primary roll of coating material to the web moving between the first and the second guide rolls, the primary flow of coating material being applied through a coater outlet of a short dwell coater disposed adjacent to the web and between the guide rolls, the arrangement being such that the web supported by the blanket moves in a plane disposed tangentially relative to the guide rolls so that secondary flows of coating material within the coater are inhibited; and urging a resilient blade disposed downstream relative to the outlet and adjacent to the second guide roll towards the second guide roll so that the blade is fully supported by the second guide roll, thereby inhibiting secondary flows of coating material within the coater.

* * * * *